US011292259B2

(12) United States Patent
Williams

(10) Patent No.: US 11,292,259 B2
(45) Date of Patent: Apr. 5, 2022

(54) FLUID INTERCONNECT

(71) Applicant: Hewlett-Packard Development Company, L.P., Spring, TX (US)

(72) Inventor: Kenneth Russell Williams, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 6 days.

(21) Appl. No.: 16/765,773

(22) PCT Filed: Nov. 9, 2018

(86) PCT No.: PCT/US2018/060173

§ 371 (c)(1),
(2) Date: May 20, 2020

(87) PCT Pub. No.: WO2020/096622

PCT Pub. Date: May 14, 2020

(65) Prior Publication Data

US 2020/0282731 A1 Sep. 10, 2020

(51) Int. Cl.

| | |
|---|---|
| ***B41J 2/175*** | (2006.01) |
| ***B41J 2/18*** | (2006.01) |
| ***B41J 2/19*** | (2006.01) |

(52) U.S. Cl.

CPC ..... *B41J 2/17513* (2013.01); *B41J 2/17523* (2013.01); *B41J 2/18* (2013.01); *B41J 2/19* (2013.01)

(58) Field of Classification Search

CPC .... B41J 2/17513; B41J 2/175; B41J 2/17556; B41J 2/17509; B41J 2/17523; B41J 2/17553; B41J 2/19; B41J 2/17566; B41J 2/17506; B41J 2/18; B41J 2002/14169

See application file for complete search history.

(56) References Cited

U.S. PATENT DOCUMENTS

| | | | | |
|---|---|---|---|---|
| 5,504,510 | A | 4/1996 | Miyakawa | |
| 5,812,168 | A | 9/1998 | Pawlowski et al. | |
| 6,217,164 | B1 | 4/2001 | Hino | |
| 6,464,346 | B2 | 10/2002 | Otis et al. | |
| 7,241,000 | B2 | 7/2007 | Hirota et al. | |
| 7,628,475 | B2 | 12/2009 | Langford et al. | |
| 7,976,143 | B2 * | 7/2011 | Morgan | B41J 2/17556 347/86 |
| 2007/0132816 | A1 | 6/2007 | Ota et al. | |
| 2008/0043076 | A1 | 2/2008 | Coffey et al. | |
| 2008/0143802 | A1 | 6/2008 | Morgan et al. | |
| 2008/0297546 | A1 | 12/2008 | Lee et al. | |
| 2012/0026219 | A1 * | 2/2012 | Tamaki | B41J 2/16526 347/6 |

FOREIGN PATENT DOCUMENTS

| | | | |
|---|---|---|---|
| EP | 1297963 | B1 | 10/2008 |

* cited by examiner

*Primary Examiner* — Jannelle M Lebron
(74) *Attorney, Agent, or Firm* — HP Inc. Patent Department

(57) ABSTRACT

In one example, a fluid interconnect to exchange liquid in a first container with air in a second container that is unvented during an exchange. The interconnect includes a first conduit, a second conduit, and an air flow director to direct air in a second container toward the second conduit during an exchange when a first container and a second container are connected to the interconnect.

13 Claims, 4 Drawing Sheets

FLUID INTERCONNECT

BACKGROUND

Inkjet type dispensing devices dispense liquid onto a substrate with a printhead or an array of printheads. For example, inkjet printers dispense ink onto paper and other print substrates. For another example, some additive manufacturing machines dispense liquid fusing agents onto a powdered build material with an inkjet type dispenser. Additive manufacturing machines that use inkjet type dispensers are commonly referred to as 3D printers.

DRAWINGS

The same part numbers designate the same or similar parts throughout the figures. The figures are not necessarily to scale.

DESCRIPTION

Figure 1:
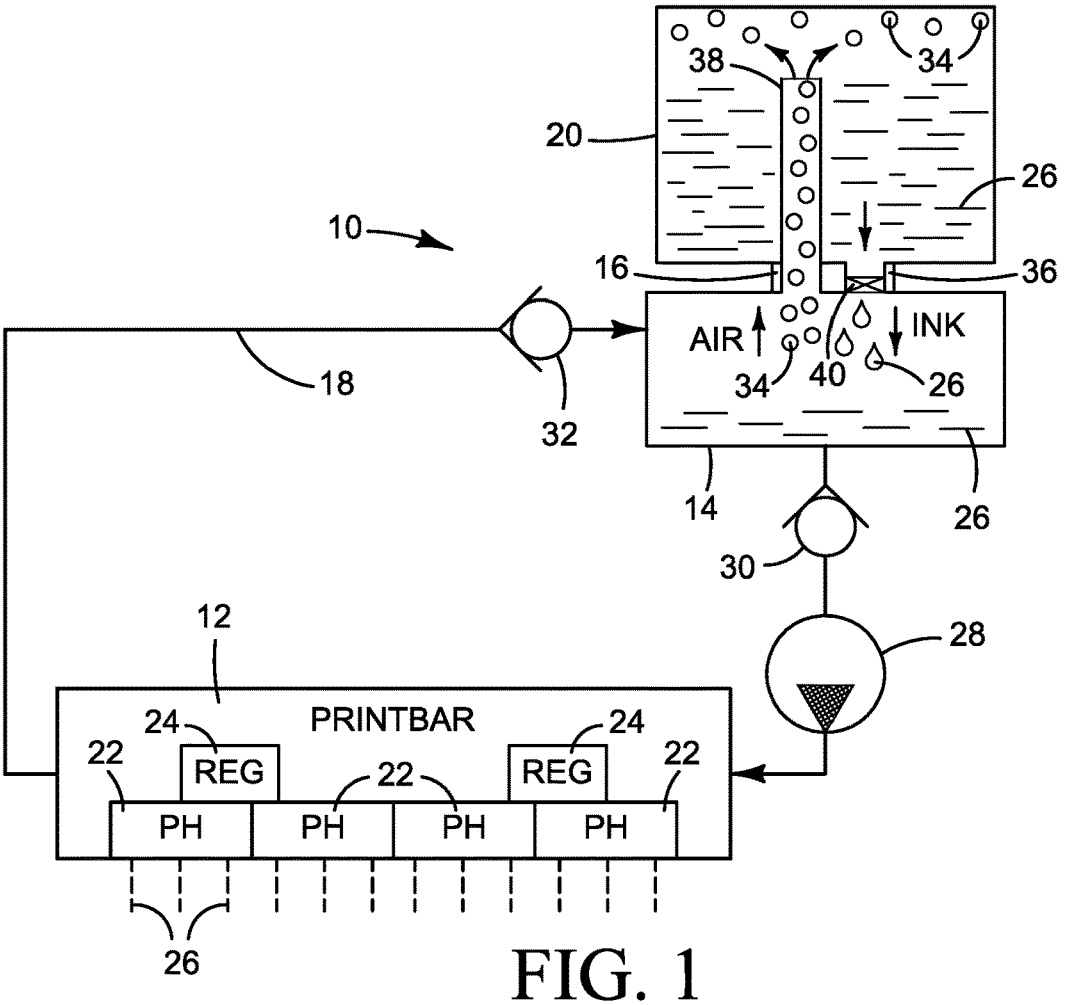
FIG. 1 illustrates a liquid delivery system for an inkjet type dispenser implementing one example of a fluid interconnect.

In some inkjet printers, the printheads are assembled in a printbar that spans a full width of the print substrate. Ink is pumped to the printbar from a permanent reservoir separate from the printbar to continuously supply the printheads with ink. The pump may circulate ink from the reservoir to the printbar and back to the reservoir to remove air from the printbar and to maintain ink pressure to the printheads during printing. When the printheads are idle, the pump may be run to circulate ink to keep ink components mixed and to continue to carry air away from the printbar. A separate reservoir, pump, and flow path are used for each of the different color inks, and for each of any other printing liquids that may be dispensed by the printheads. This type of ink delivery system is sometimes called a "continuous ink" system.

Each reservoir in a continuous ink delivery system may be resupplied from a removable container temporarily connected to the reservoir. To prevent a spill if the reservoir is over filled, the resupply container may be sealed to the reservoir. In a sealed resupply system, air in the reservoir is exchanged with ink in the resupply container as the reservoir fills with ink. Ink and air may be exchanged through a single conduit that alternately flows ink into the reservoir and burps air into the resupply container. Multiple conduits may be used to speed the exchange one (or more) for ink to flow into the reservoir and one (or more) for air to escape into the resupply container. When a full resupply container is first connected to a reservoir, both conduits will be full of ink. Air does not pass quickly through an air/ink interface because it takes time to build enough bubble pressure to overcome the capillary forces of the liquid. To reduce the duration of the air/ink interface at the inlet to an air conduit, the outlet from the air conduit may be extended to near the back of the resupply container so that air will fill the conduit after just a small amount of ink leaves the container. Even so, a multi-conduit interconnect should consistently initiate air flow into the air conduit rather than into the ink conduit.

Absent an air flow director, air may initially enter the ink conduit instead of the air conduit.

A new fluid interconnect has been developed to help consistently initiate air flow from the reservoir into the air conduit during a resupply operation. In one example, the interconnect includes an air flow director to direct air in the reservoir to the air conduit as ink flows into the reservoir. Air may be directed to the air conduit by impeding the flow of air into the ink conduit relative to the air conduit. In one example, a grating at the outlet from the ink conduit increases the bubble pressure at the air/ink interface of the ink conduit compared to the air conduit. The lower bubble pressure at the inlet to the air conduit allows air to enter the air conduit more easily than the ink conduit, to help consistently initiate air flow from the reservoir into the air conduit.

Examples are not limited to ink or inkjet printing in general. Examples may be implemented with other liquids and for other inkjet type dispensers. The examples described herein illustrate but do not limit the scope of the patent, which is defined in the Claims following this Description.

As used in this document, "a" and "an" means one or more, "and/or" means one or more of the connected things, and a "liquid" means a fluid not composed primarily of a gas.

FIG. 1 illustrates a liquid delivery system for an inkjet type dispenser implementing one example of a new resupply interconnect. Referring to FIG. 1, system 10 includes a printhead unit 12, a permanent reservoir 14 separate from printhead unit 12, a resupply interconnect 16, and a flow path 18 from reservoir 14 through printhead unit 12 and back to reservoir 14. System 10 also sometimes includes a removable liquid container 20 to resupply reservoir 14 with ink or other liquid. In one example, interconnect 16 is a detachable part discrete from reservoir 14 and container 20. In other examples, some or all of interconnect 16 is part of reservoir 14 and/or container 20.

Printhead unit 12 includes one or multiple printheads to dispense ink or another liquid and flow structures to carry liquid to the printhead(s). A printhead unit 12 usually will also include a pressure regulator or other flow control device to help control the flow of liquid to each printhead. In this example, printhead unit 12 is implemented as a printbar with multiple printheads 22 and flow regulators 24 each to regulate the flow of liquid to the corresponding printheads 22. Although a single printhead unit 12 is shown, system 10 may include multiple printhead units 12. Printhead unit 12 may be implemented, for example, as a substrate wide printbar in an inkjet printer to dispense ink and/or other printing liquids, or as an agent dispenser in an additive manufacturing machine to dispense fusing, detailing, coloring, and/or other liquid manufacturing agents. Each of multiple liquid delivery systems 10 may be used to deliver each of multiple corresponding liquids. System 10 may also include a pump 28 to move liquid along flow path 18 and check valves or other suitable pressure control devices 30, 32 to help regulate the flow of liquid along flow path 18.

Figure 2:
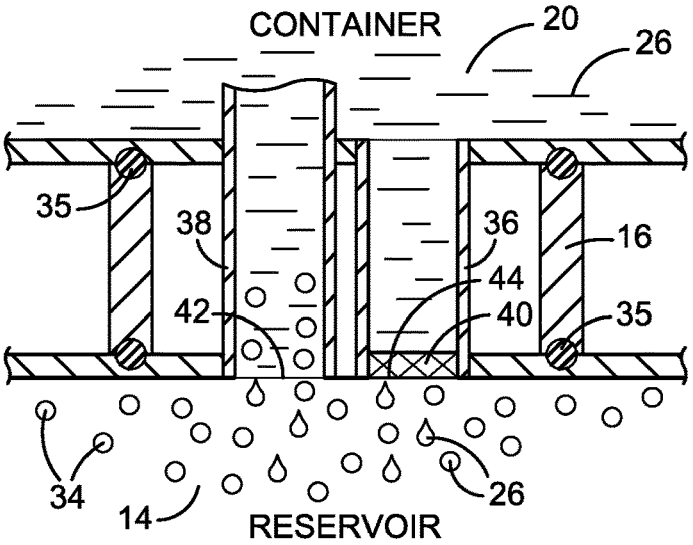
FIG. 2 illustrates an example fluid interconnect such as might be implemented in the liquid delivery system shown in FIG. 1.
Figure 3:
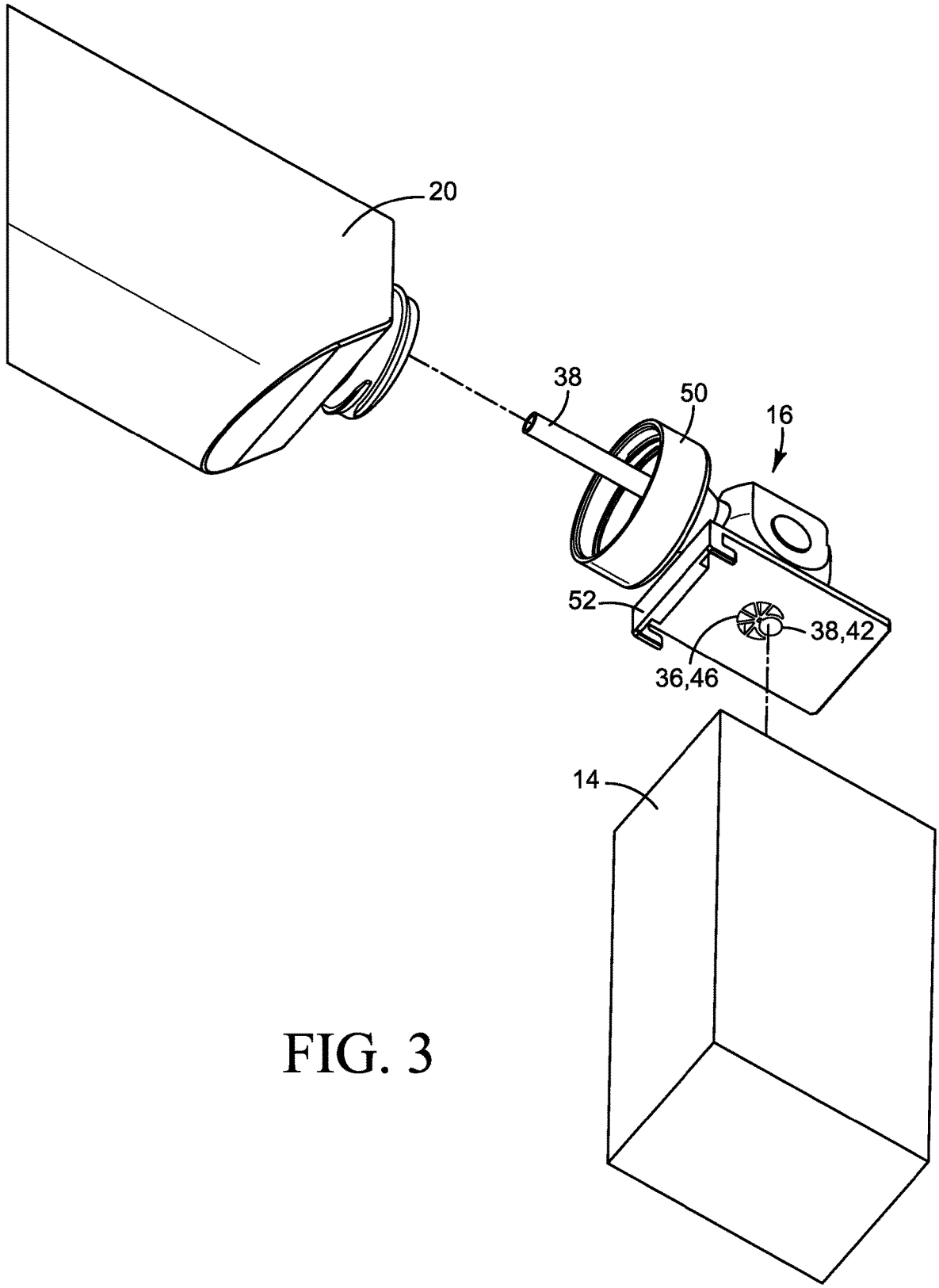
FIGS. 3-8 illustrate another example fluid interconnect such as might be implemented in the liquid delivery system shown in FIG. 1.
Figure 4:
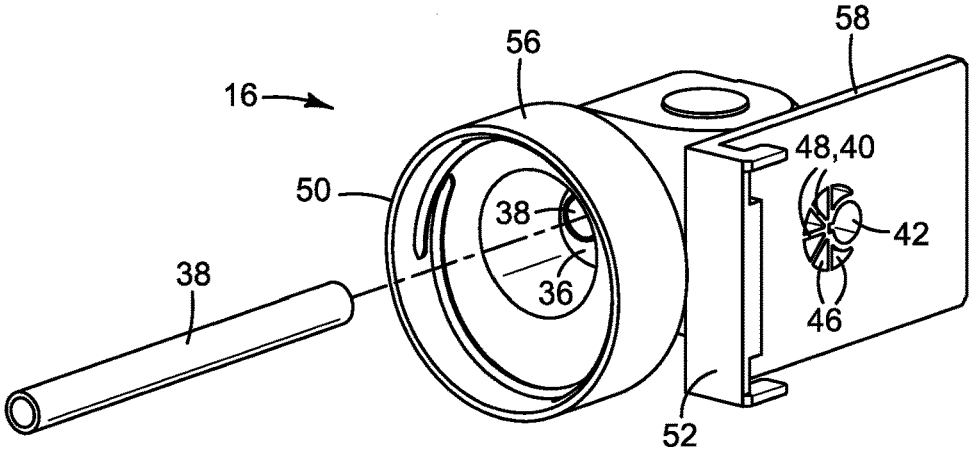

FIG. 2 is a more detailed view of an interconnect 16 showing an initial, transition state of air and liquid flow soon after a resupply container 20 is attached to a reservoir 14. FIG. 1 shows a steady state of air and liquid flow after liquid has drained from the air conduit into reservoir 14. Referring to FIGS. 1 and 2, interconnect 16 is sealed against reservoir 14 and resupply container 20 with seals 35 to prevent a spill if reservoir 14 is over filled. In a sealed resupply system, interconnect 16 enables the exchange of liquid 26 in resupply container 20 and air 34 in reservoir 14 during a resupply operation. Interconnect 16 includes a first conduit 36 to carry liquid 26 from resupply container 20 to reservoir 14, a second conduit 38 to carry air from reservoir 14 to container 20, and an air flow director 40 to direct the flow of air 34 toward the inlet 42 to air conduit 38.

An air flow director 40 may be implemented, for example, by impeding the flow of air into ink conduit 36 relative to air conduit 38. Thus, in one example, interconnect 16 includes an impediment to air entering the outlet 46 from liquid conduit 36. An impediment 40 may be implemented, for example, as a grating, screen or other feature that increases the bubble pressure for air to enter liquid conduit 36 compared to air conduit 38. The lower bubble pressure at air inlet 42 compared to liquid outlet 46 encourages air to flow preferentially into air conduit 38, to help consistently initiate air flow from reservoir 14 into air conduit 38. In this example, air conduit 38 extends to near the back of resupply container 20 so that air 34 may completely fill conduit 38 after just a small amount of liquid 26 leaves container 20, to reduce the duration of the air/liquid interface at the inlet 42 to conduit 38.

FIGS. 3-8 illustrate one example implementation for a resupply interconnect 16 shown in FIGS. 1 and 2. Referring to FIGS. 3-8, interconnect 16 includes a liquid conduit 36, an air conduit 38, and a grating 40 at the outlet 46 from liquid conduit 36. Grating 40 increases the bubble pressure for air to enter conduit 36, and thus functions to direct the flow of air to air conduit 38. In this example, grating 40 is configured as a series of ribs 48 radiating out from the center of a circular outlet 46. Bubble pressure at an air/liquid interface depends on the ratio of the perimeter of the opening at the interface to the area of the interface (perimeter/area). A higher ratio raises the bubble pressure. Ribs 48 increase the perimeter of the opening to increase the perimeter/area ratio, thus increasing the bubble pressure.

Other suitable flow directors are possible. For example, a screen, mesh or filter may be appropriate in some implementations to increase perimeter, and thus bubble pressure.

Figure 7:
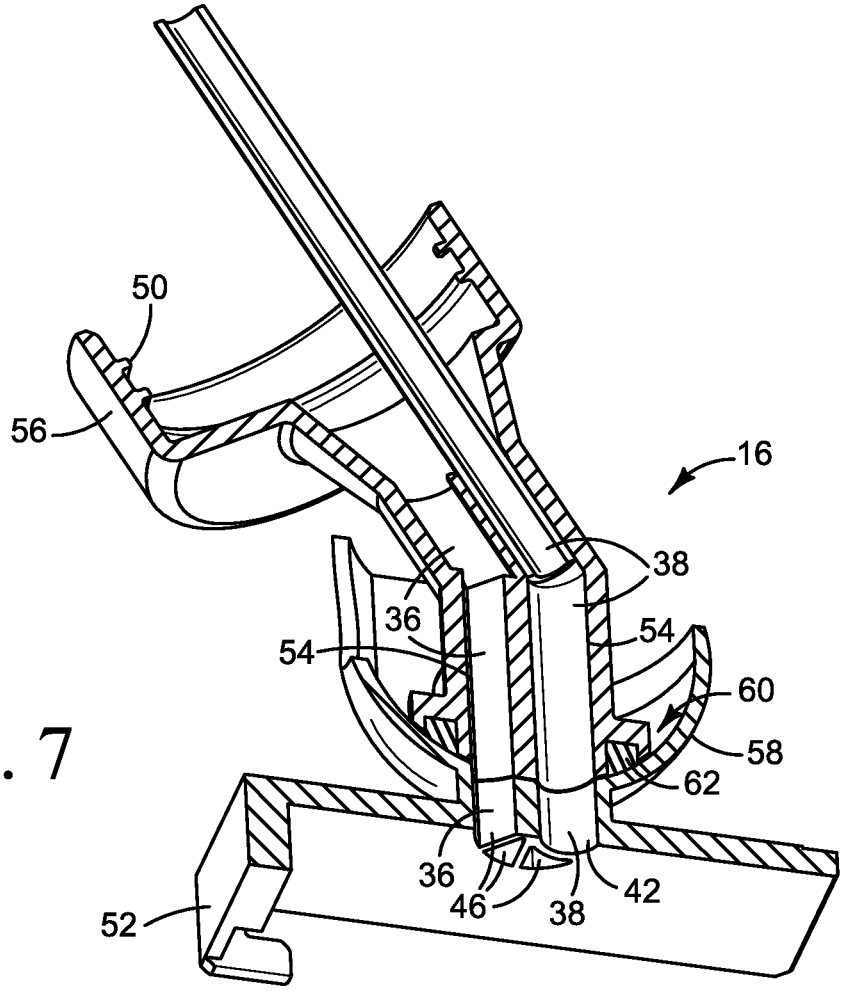
Figure 8:
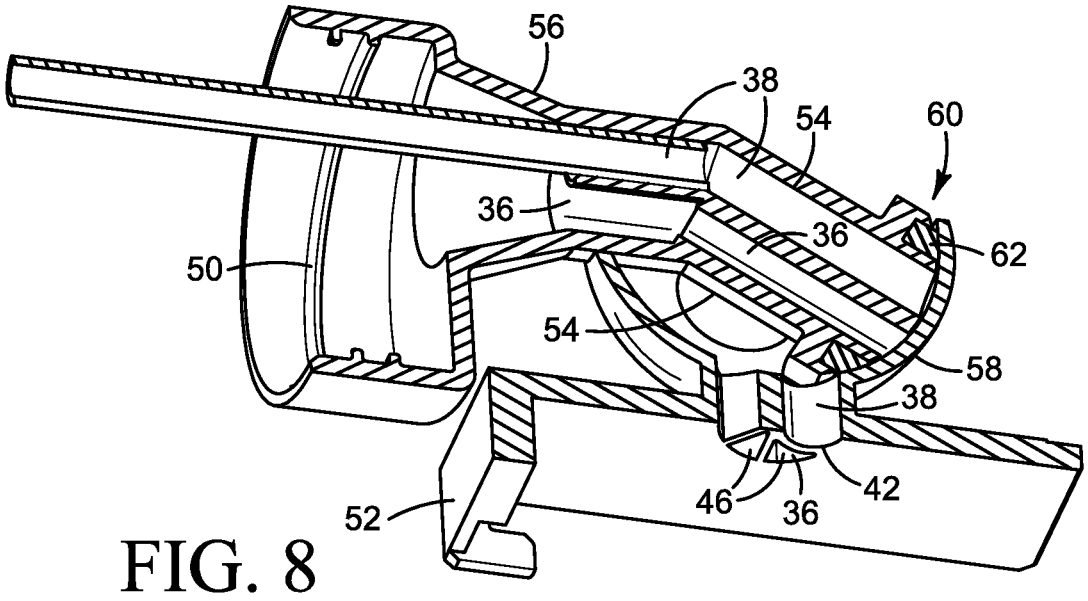

In this example, interconnect 16 includes a threaded connector 50 that screws on to a mating part of resupply container 20 and a bracketed connector 52 that attaches to a mating part of reservoir 14. Also in this example, both conduits 36, 38 are nested together within the perimeter of a circular passage 54 through interconnect 16. A nested configuration such as that shown in FIGS. 3-8 may be desirable, for example, to facilitate a valve function for interconnect 16. Interconnect 16 may be configured as an assembly of parts 56 and 58 that form a ball type valve 60 at an arcuate internal interface between the two parts. A valve seal 62 seals the interface between interconnect parts 56, 58. FIG. 7 shows valve 60 in an open position in which the conduits in parts 56, 58 are aligned to allow fluid flow. FIG. 8 shows valve 60 in a closed position in which the conduits in parts 56, 58 are not aligned, to block fluid flow.

Figure 5:
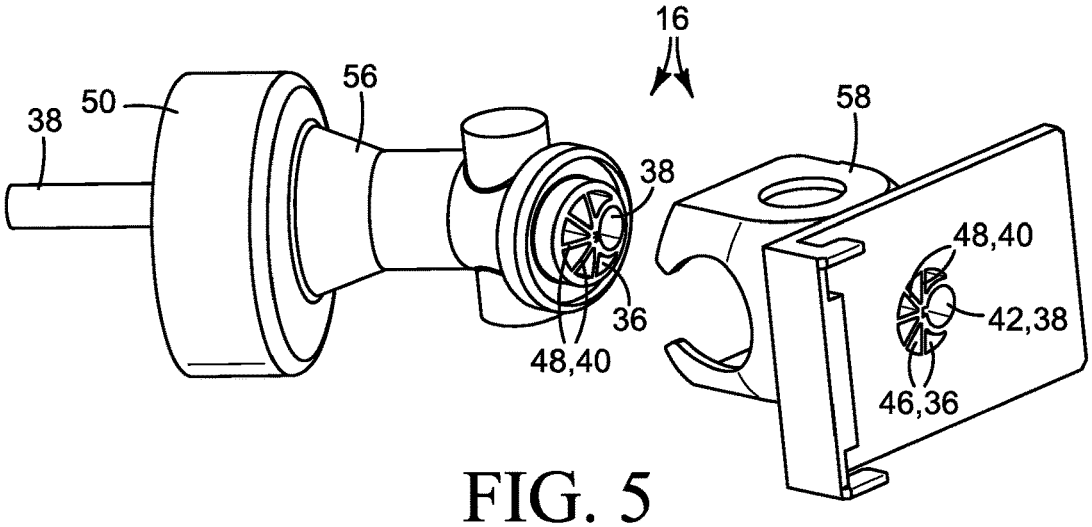
Figure 6:
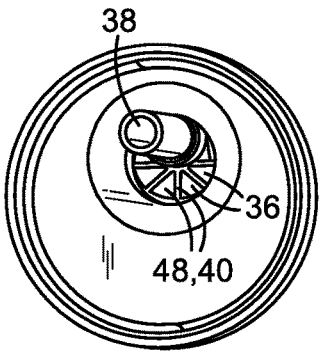

Each conduit 36, 38 may bend through interconnect 16, if desired, to accommodate position and space limitations as well as to facilitate the operation of valve 60. Usually it will be desirable to position grating 40 (or other impediment to air flow) at liquid conduit outlet 46. However, it may be possible and even desirable in some applications to locate grating 40 upstream (in the direction of liquid flow) from outlet 46, for example to improve part strength and enhance moldability. In the example shown in FIGS. 3-8, grating 40 includes ribs 48 in both parts 50, 52 and thus on both sides of valve 60, as best seen in FIG. 5.

As noted at the beginning of this Description, the examples shown in the figures and described above illustrate but do not limit the scope of the patent, which is defined in the following Claims.

The invention claimed is:

1. A fluid interconnect to exchange liquid in a first container with air in a second container connected to the first container in a system that is unvented during an exchange, the interconnect comprising:

a first conduit;

a second conduit; and an air flow director comprising a grating across the first conduit to impede air entering the first conduit such that air in the second container is directed toward the second conduit during an exchange when the first container and the second container are connected to the interconnect.

2. The interconnect of claim 1, wherein the grating comprises a grating across an opening into the first conduit.

3. The interconnect of claim 1, wherein the grating comprises multiple ribs each radiating out from a center of the opening.

4. A fluid interconnect to exchange liquid in a first container with air in a second container connected to the first container in a system that is unvented during an exchange, the interconnect comprising:

a first connector to connect to the first container containing liquid;

a second connector to connect to the second container containing air;

a first conduit that extends from the first connector to the second connector, the first conduit having:

a first open end exposed to an interior of the first container when the first connector is connected to the first container; and a second open end exposed to an interior of the second container when the second connector is connected to the second container; and a second conduit that extends from the first connector to the second connector, the second conduit having:

a first open end exposed to an interior of the first container when the first connector is connected to the first container; and a second open end exposed to an interior of the second container when the second connector is connected to the second container; and wherein the second open end of the first conduit has a greater resistance to the entry of air than the second open end of the second conduit when both conduits are filled with liquid.

5. A device to exchange liquid in a first container with air in a second container connected to the first container in an unvented system, the device comprising:

a first conduit between the containers when the containers are connected, the first conduit having a first opening to the second container when the containers are connected, the first opening having a first ratio of perimeter to area; and a second conduit between the containers when the containers are connected, the second conduit having a second opening to the second container when the containers are connected, the second opening having a second ratio of perimeter to area; and wherein the first ratio is greater than the second ratio.

6. The device of claim 5, wherein the first opening is partially obstructed by a grating and the second opening is unobstructed.

7. The device of claim 6, wherein the first opening is at least partially circular and the grating comprises ribs radiating out from a center of the first opening.

8. The device of claim 5, wherein the first conduit partially surrounds the second conduit.

9. A liquid delivery system for an inkjet type dispenser, comprising:

a printhead unit;

a reservoir separate from the printhead unit;

a flow path from the reservoir through the printhead unit and back to the reservoir; and an interconnect to connect a removable container to the reservoir, the interconnect including a first conduit through which fluid may pass between the reservoir and the container and a second conduit through which fluid may pass between the reservoir and the container, the first conduit having a greater resistance to air flow than the second conduit when both conduits are filled with liquid, such that air in the reservoir will enter the second conduit more easily than the first conduit.

10. The system of claim 9, wherein a bubble pressure at a reservoir end of the first conduit is greater than a bubble pressure at a reservoir end of the second conduit.

11. The system of claim 10, comprising an impediment to air entering the reservoir end of the first conduit.

12. The system of claim 11, wherein the impediment comprises a grating on an opening into the reservoir end of the first conduit.

13. The system of claim 12, wherein the grating comprises multiple ribs each radiating out from a center of the opening.

* * * * *